United States Patent [19]

Rodebaugh et al.

[11] Patent Number: 4,705,084

[45] Date of Patent: Nov. 10, 1987

[54] COVER FOR OUTDOOR TABLE AND BENCHES

[76] Inventors: Jimmy L. Rodebaugh; Onetta R. Rodebaugh, both of R.R. #1, Box 660, Ochelata, Okla. 74051

[21] Appl. No.: 738,412

[22] Filed: May 28, 1985

[51] Int. Cl.[4] ..... A47B 13/00

[52] U.S. Cl. ..... 150/52 R; 2/275; 108/90

[58] Field of Search ..... 150/52 R, 52 K; 5/495–498; 297/219; 108/90; 38/140; 2/275

[56] References Cited

U.S. PATENT DOCUMENTS

| | | | |
|---|---|---|---|
| 177,876 | 5/1876 | Nichols | 2/275 |
| 742,346 | 10/1903 | McNeil | 2/275 |
| 1,066,256 | 7/1913 | Curran | 2/275 |
| 1,287,597 | 12/1918 | Murray | 38/140 |
| 1,719,364 | 7/1929 | Gilkey | 150/52 F |
| 1,817,404 | 8/1931 | Whaley | 5/496 |
| 2,057,551 | 10/1936 | Bishop | 5/496 |
| 2,151,381 | 3/1939 | Goldsmith | 2/275 |
| 2,381,580 | 8/1945 | Einbinder | 2/275 |
| 2,586,153 | 2/1952 | Eisman | 150/52 R |
| 2,727,253 | 12/1955 | Tomsic | 5/496 |
| 2,809,466 | 10/1957 | Glover | 150/52 R |
| 3,353,867 | 11/1967 | Anderson | 297/219 |
| 3,372,404 | 3/1968 | Getchell et al. | 2/275 |
| 3,849,813 | 11/1974 | Nielson | 5/495 |
| 4,396,227 | 8/1983 | Nielson | 297/219 |

FOREIGN PATENT DOCUMENTS

| | | | |
|---|---|---|---|
| 564236 | 2/1958 | Belgium | 150/52 R |
| 1316564 | 5/1973 | United Kingdom | 297/219 |
| 1574312 | 9/1980 | United Kingdom | 150/52 R |

*Primary Examiner*—Stephen Marcus
*Assistant Examiner*—Gary E. Elkins
*Attorney, Agent, or Firm*—John Wade Carpenter

[57] ABSTRACT

A removable cover for an outdoor table or a bench, each of which would include four corners. In one embodiment of the removable cover, the cover includes a plurality of interconnecting panels having a pair of opposed outermost panels. Each of the pair of outermost panels has a pair of opposed panel sides and a pair of corners including a seam at each corner such that when the cover removably lodges over the top of the rectangular surface of the table or the bench, each of the seams essentially snugly engages the general vertical section of one of the corners of the rectangular surface of the table or the bench, and a breadth depending skirt is integrally formed. In another embodiment of the removable cover, the removable cover includes a sheet instead of a plurality of panels. The sheet may also include the seams with the skirt. At least one loop is secured to each of the pair of outermost panels between the respective pair of seams. The removable cover additionally comprises a pair of outer straps opposedly secured to the pair of opposed panel sides of each of the pair of outermost panels, or the sheet in another embodiment of the cover, and the straps are adapted to slidably, removably pass through the loop and bind together to releasably secure the cover to the top of the rectangular surface of the table or bench.

19 Claims, 20 Drawing Figures

FIG. 1
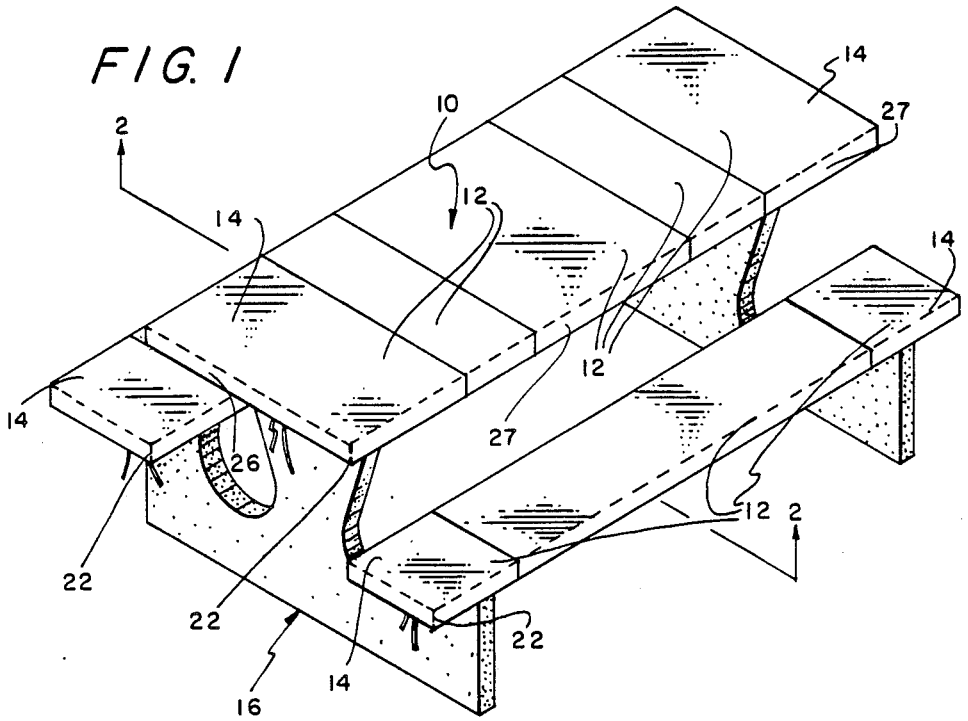
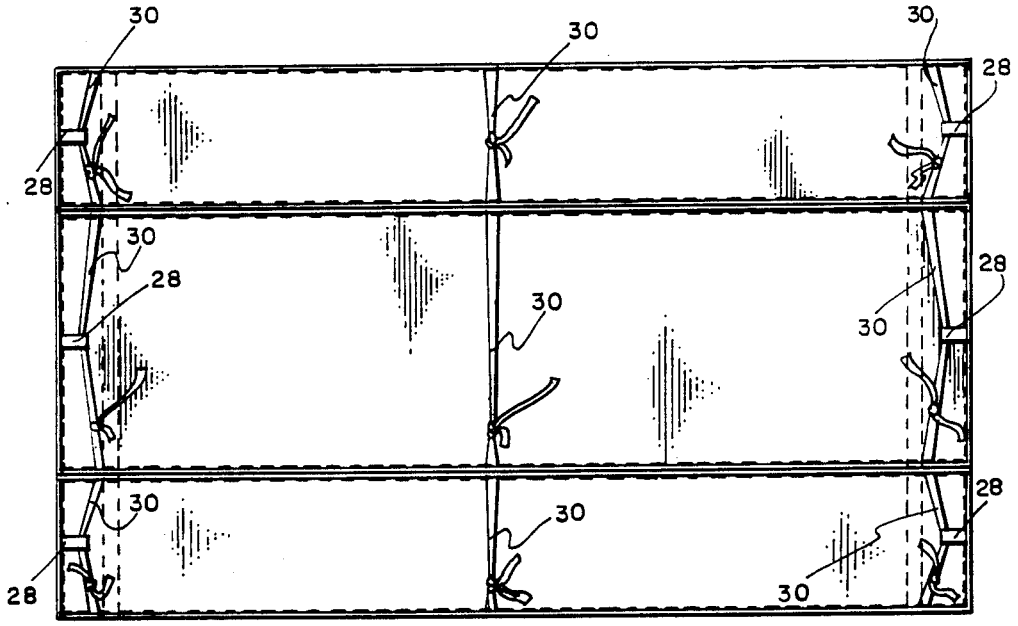
FIG. 2

FIG. 3
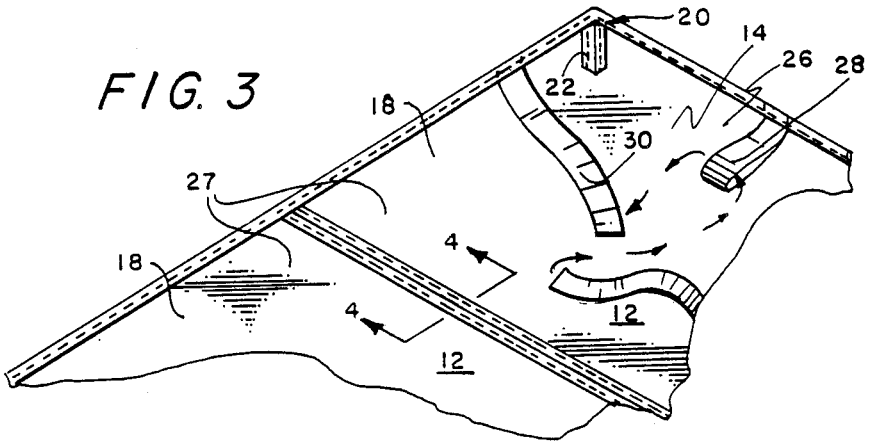
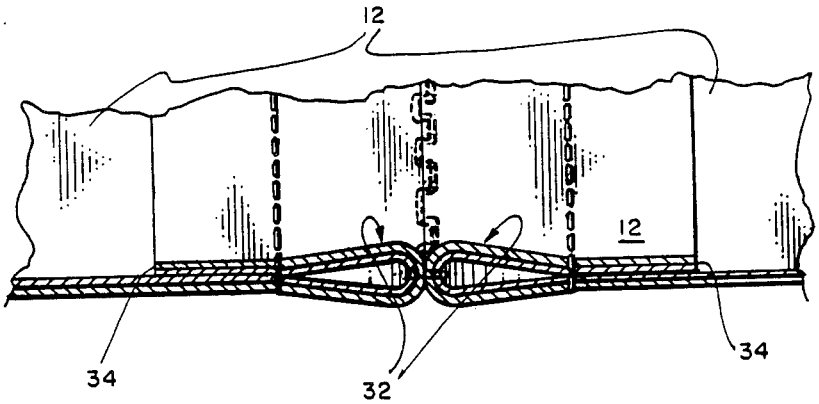
FIG. 4
FIG. 5
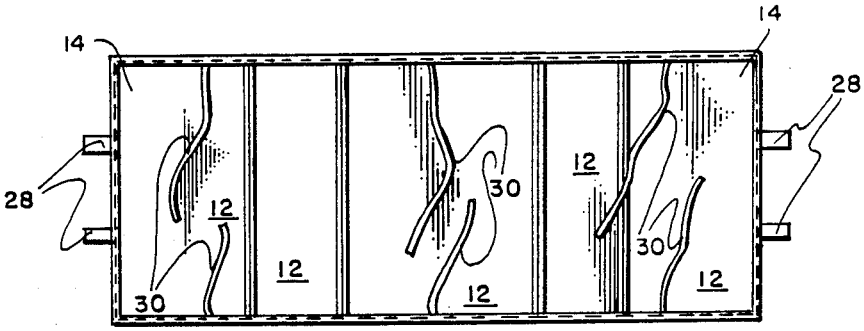
FIG. 6
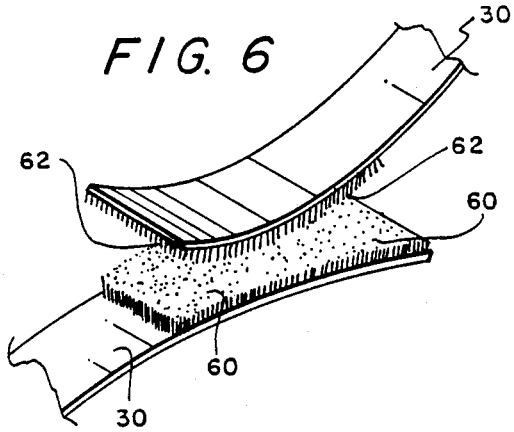
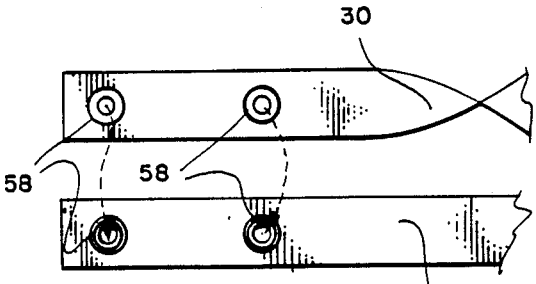
FIG. 7

COVER FOR OUTDOOR TABLE AND BENCHES

BACKGROUND OF THE INVENTION

1. Field of the Invention

This invention is related to a removable cover. More specifically, this invention provides a removable cover set for a picnic table and benches.

2. Description of the Prior Art

U.S. Pat. No. 3,226,545 to Kruissink discloses a stadium bench cover, and more particularly, a unitary device adapted to be instaled over the usual wooden plank-like benches found in stadia. U.S. Pat. No. 3,279,515 by Kesh teaches a cover for a picnic table having straps which can be arranged to be received under the top of the table. U.S. Pat. No. 3,295,577 by Danielson teaches an adjustable cover capable of being tightened over a surface, such as a table top. U.S. Pat. No. 3,310,091 to Geisen relates to covers for generally flat objects such as tables, benches, and the like, and more particularly to a new and unique cover for such objects which is adjustable to cover a range of different sizes, and which snugly retains itself upon the object which it covers. U.S. Pat. No. 3,785,419 illustrates a removable cover for a table comprising an upper portion overlying the top of the table, a perimetrical skirt portion disposed on the sides of the table, and annularly extending restraining means for removably securing the cover to the top of the table. U.S. Pat. No. 3,960,193 to Davis illustrates a weighted picnic table cloth. None of the foregoing prior art teaches or suggests the particular removable cover of this invention for picnic tables and benches.

SUMMARY OF THE INVENTION

The present invention accomplishes its desired objects by broadly providing a removable cover for a rectangular surface means having four corners. The removable cover comprises a plurality of interconnecting panels having a pair of opposed outermost panels and adapted to overlie the top of the rectangular surface means. Each of the pair of outermost panels has a pair of opposed panels sides and a pair of corners including a seam means at each corner such that when the cover removably lodges over the top of the rectangular surface means, each of the seam means essentially snugly engages the generally vertical section of one of the corners of the rectangular surface means and a breadth depending skirt is integrally formed. The breadth depending skirt has a width approximately equaling the length of the seam means and extends over the breadth edge of the rectangular surface means. At least one loop means is secured to the pair of outermost panels between the respective pair of seam means. A pair of outer straps is opposedly secured to the pair of opposed panel sides of each of the pair of outermost panels and is adapted to slidably, removably pass through the loop means and bind together to releasably secure the cover to the top of the rectangular surface means.

The present invention also accomplishes its desired objects by providing a removable cover comprising a sheet means having a pair of opposed sheet sides and adapted to overlie the top of the rectangular surface means. The sheet means includes a pair of opposed sheet ends. Each of the sheet ends has a pair of corners including a seam means at each corner such that when the cover removably lodges over the top of the rectangular surface means, each of the seam means essentially snugly engages the general vertical section of one of the corners of the rectangular surface means and a breadth depending skirt is integrally formed with a width approximately equaling the length of the seam means and extending over the breadth edge of the rectangular surface means. At least one loop means is secured to each of the pair of sheet ends between the respective pair of seam means. A pair of outer straps is opposedly secured to the pair of opposed sheet sides in proximity to each of the pair of sheet ends and is adapted to slidably, removably pass through the loop means and bind together to releasably secure the cover to the top of the rectangular surface means.

The present invention also further accomplishes its desired objects by providing various other embodiments of the removable cover as set forth hereinafter.

Therefore, it is an object of the present invention to provide a removable cover for a table and/or a bench.

It is another object of the present invention to provide a removable cover set for a picnic table and picnic benches.

These, together with the various ancillary objects and features which will become apparent to those skilled in the art as the following description proceeds, are attained by this removable cover, a preferred embodiment being shown with reference to the accompanying drawings, by way of example only, wherein:

BRIEF DESCRIPTION OF THE DRAWINGS

FIG. 1 is a perspective view of a picnic table and a pair of benches covered with one embodiment of the removable cover set;

FIG. 2 is a bottom plan view taken in direction of the arrows and along the plane of line 2—2 in FIG. 1;

FIG. 3 is an enlarged partial perspective view of one embodiment of the table cover with a seam;

FIG. 4 is a vertical sectional view taken in direction of the arrows and along the plane of line 4—4 in FIG. 3;

FIG. 5 is a bottom plan view of another embodiment of the removable cover;

FIG. 6 is an enlarged perspective view of the ends of the straps including Velcro fastening means;

FIG. 7 is an enlarged perspective view of the ends of the straps including clamp or fastening means;

DETAILED DESCRIPTION OF THE INVENTION

Figure 8:
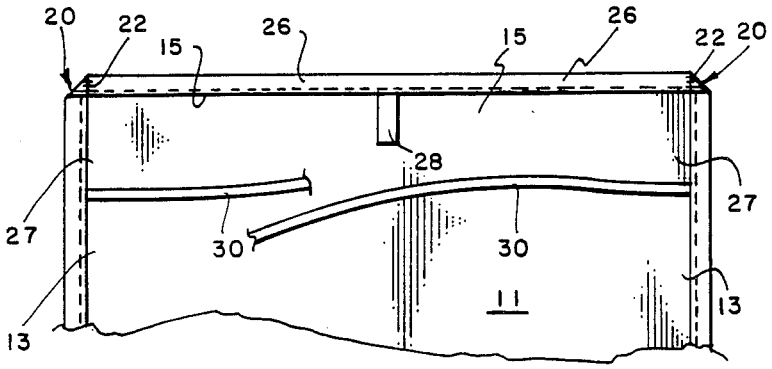
FIG. 8 is a partial bottom plan view of another embodiment of an end of the table cover.

Referring in detail now to the drawings for illustration of the various embodiments of the removable cover generally illustrated as 10 cover, and wherein like or similar parts of the removable cover are identified by like reference numerals, and particularly initially of FIGS. 1, 3-5, and 9-11, there is seen in general the cover 10 having a plurality of interconnecting panels 12 including a pair of opposed outermost panels 14—14. The interconnected panels 12 are preferably of diverse colors and are adapted to overlie the top of a rectangular surface, such as a picnic table and/or bench, generally illustrated as 16 in FIG. 1.

Figure 11:
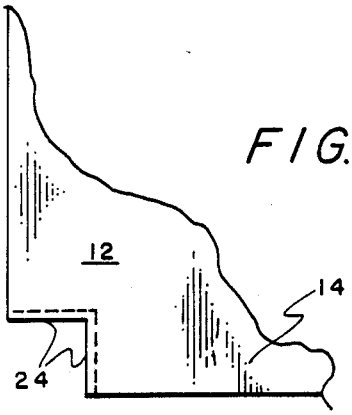
FIG. 11 is a partial bottom plan view of a removable cover with a corner removed in order to form a seam along the edges of the removed corner.
Figure 12:
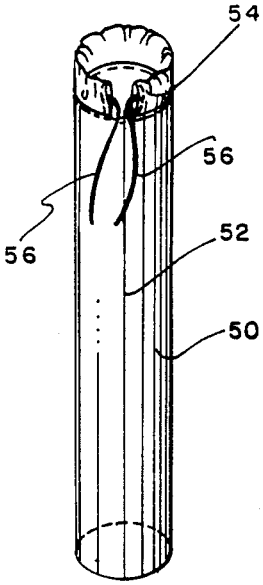
FIG. 12 is a perspective view of the bag which can carry the removable cover set.
Figure 13:
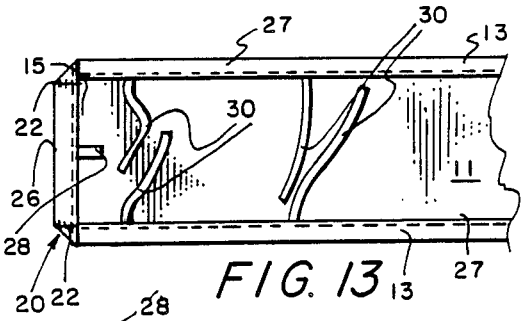
FIG. 13 is a partial bottom plan view of still yet another embodiment of the removable cover.

With respect to the preferred embodiments of the removable cover 10 in FIGS. 1, 3 and 11, each of the interconnecting panels 12 has a pair of opposed panel sides 18—18. Each of the pair of outermost panels 14—14, in addition to having a pair of opposed panel sides 18—18, has a pair of corners, generally illustrated as 20. The corners 20 are formed with a seam 22 which is the result of removing a generally square section (see FIG. 11) and stitching together the remaining edges 24—24 of the removed square section. The distance between the pair of seams 22—22 for any of the pair of outermost panels 14—14 is less than the width of the respective outermost panel 14.

When the cover 10 removably lodges over the top of the rectangular surface, each of the seams 22 snugly engages to the general vertical section of one of the corners of the rectangular surface, and a breadth depending skirt 26 and a length depending skirt 27 are integrally formed. The breadth depending skirt 26 has a width approximately equal to the length of the seam 22 (or the length of the remaining edges 24—24 in FIG. 11) and extends over the breadth edge of the rectangular surface. The length depending skirt 27 (see FIG. 1) is integrally formed along the pair of opposed panel sides 18—18 for all of the plurality of interconnecting panels 12. As was the case for the breadth depending skirt 26, the length depending skirt 27 has a width approximately equal to the length of the seam 22 (or the length of the remaining edges 24—24 in FIG. 11) and extends over the longitudinal edge of the rectangular surface.

Loops 28 are secured perimetrically to each of the panels 14—14 between the respective pair of seams 22—22. Straps 30 are opposedly secured to the pair of opposed panel sides 18—18 of each of the pair of outermost panels 14—14. The straps 30—30 are adapted to slidably, removably pass through the loops 28 and bind together underneath the rectangular surface to releasably secure the cover 10 to the top of the rectangular surface. A pair of inner straps 30—30 is preferably opposedly secured to the pair of opposed panel sides 18—18 of a panel 12 positioned between the pair of outermost panels 14—14 (see FIG. 2) to pass underneath the rectangular surface for binding together to assist in releasably securing the cover 10 to the top of the rectangular surface.

Any two contiguous interconnecting panels 12—12 includes at their respective interconnecting points ( see FIG. 4), a pair of interconnected panel loops, each generally illustrated as 32. The panel loops 32—32 are defined from looping two respective contiguous panel edges 34—34 of the two contiguous panels 12—12, respectively; securing the looped panel edges 34—34 to the structure of the respective contiguous panels; and subsequently interconnecting the respective panel loops 32 of the two contiguous panels 12.

Figure 9:
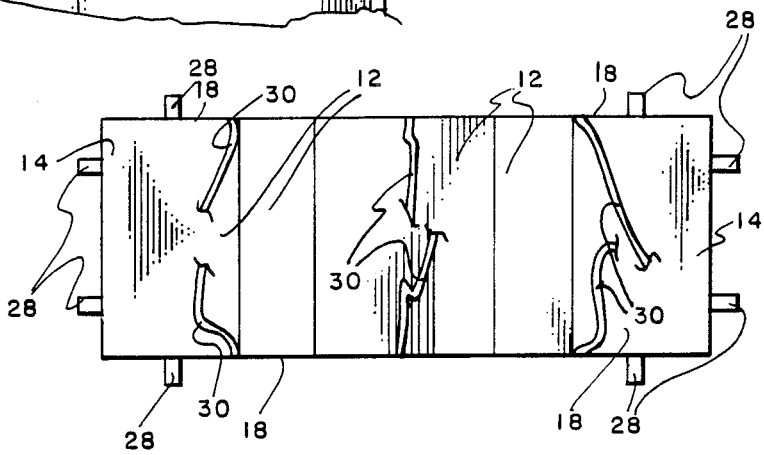
FIG. 9 is a bottom plan view of yet another embodiment of the table cover.

In the preferred embodiment for the removable cover 10 illustrated in FIGS. 5 and 9, the outermost panels 14—14 may, or may not, have the corners 20 formed with the seams 22, depending on whether or not the removable cover 10 is dimensioned to perfectly fit the rectangular surface such that the seams 22 can essentially snugly engage the generally vertical section of the corners of the rectangular surface. In the preferred embodiment for the removable cover 10 in FIG. 5, a pair of loops 28—28 is secured to each of the pair of outermost panels 14—14 between the respective pair of seams 22—22, or between the corners of the outermost panels 14—14 in the event that they do not include corners 20 formed with the seam 22. With respect to the embodiment of the removable cover 10 of FIG. 9, each of the outermost panels 14—14 include another pair of loops 28—28 opposedly secured to the pair of opposed panel sides 18—18 of each pair of the outermost panels 14—14.

Figure 10:
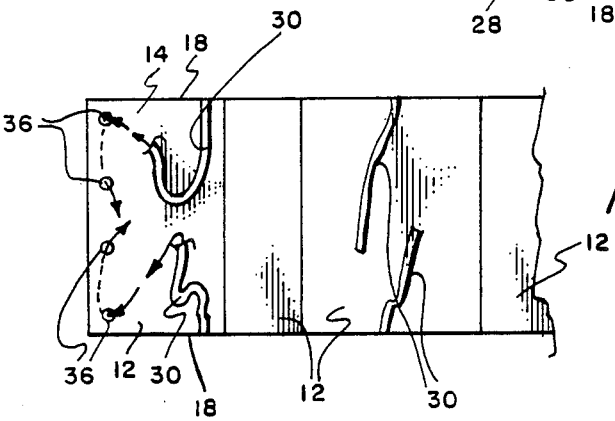
FIG. 10 is a partial bottom plan view of an embodiment of the table cover having a plurality of apertures in proximity to the ends thereof.

Each outermost panel 14 of the opposed outermost panels 14—14 for the plurality of interconnecting panels 12 in FIG. 10 has a structure defining a plurality of apertures 36 in close proximity to its respective end. The pair of outer straps 30—30 secured to the pair of opposed panel sides 18—18 of each of the outermost panels 14 in FIG. 10 slidably, removably pass through the apertures 36 and bind together to releasably secure the cover 10 to the top of the rectangular surface.

Referring in detail now to FIGS. 8, and 13-20 for other embodiments of the removable cover 10, the cover 10 comprises a sheet 11 having a pair of opposed sheet sides 13—13 and opposed sheet ends 15—15. As was the case for the embodiment of the removable cover 10 having the plurality of interconnecting panels 12, sheet 11 is adapted to overlie the top of the rectangular surface. In the preferred embodiment for the cover 10 in FIG. 8 and 13, each end 15 of the sheet 11 has the pair of corners 20—20 including the seams 22—22. The distance between the pair of seams 22—22 on the sheet ends 15—15 is less than the width of the sheet 11. When the cover 10 removably lodges over the top of the rectangular surface, each of the seams 22 snugly engages the general vertical section of one of the corners of the rectangular surface, and the breadth depending skirt 26 and the length depending skirt 27 are integrally formed, as was seen for the embodiments of FIGS. 1, 2 and 3. The breadth depending skirt 26 for sheet 11 has a width approximately equal to the length of the seam 22 and extends over the breadth edge of the rectangular surface. The length depending skirt 27 for the sheet 11 is integrally formed along the pair of opposed sheet sides 13—13; and the width of the length depending skirt 27 is approximately equal to the length of seam 22 and extends over the longitudinal edge of the rectangular surface.

Loops 28 are secured perimetrically to each of the sheet ends 15 between the respective pair of seams 22—22 for the corners 20—20 of sheet 11. Straps 30—30 are opposedly secured to the pair of opposed sheet sides 13—13 in proximity to the opposed sheet ends 15—15. These straps 30 (see FIGS. 8 and 13) are adapted to slidably, removably pass through the loops 28 and bind together to releasably secure the cover 10 to the top of the rectangular surface. The pair of inner straps 30—30 (see FIG. 13) is preferably opposedly secured to the pair of opposed sheet sides 13—13 of the sheet 11 between the pair of sheet ends 15—15 and the two pair of outer straps 30—30. The inner straps 30—30 pass underneath the rectangular surface for binding together to assist in releasably covering the top of the rectangular surface with the sheet 11 of the cover 10.

Figure 14:
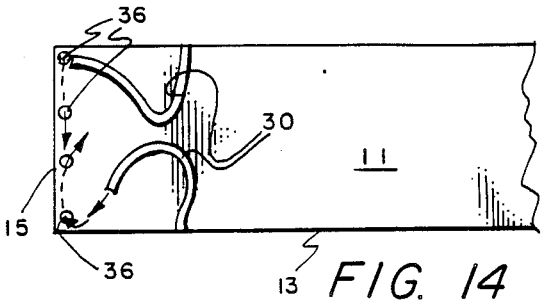
FIG. 14 is a partial bottom plan view of yet another embodiment of the removable cover.
Figure 15:
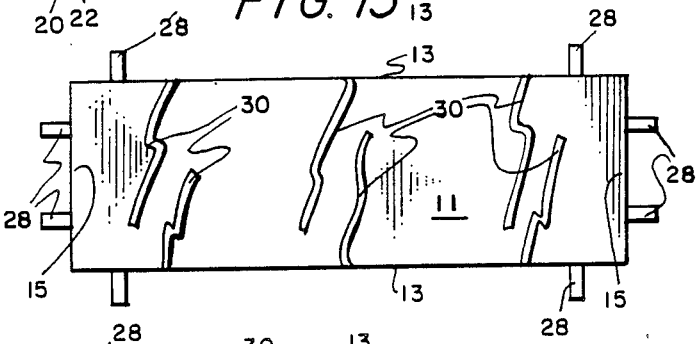
FIG. 15 is a bottom plan view of still yet another embodiment of the removable cover.
Figure 16:
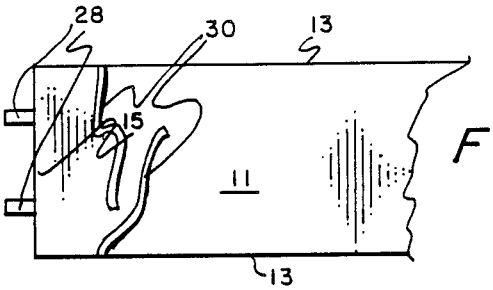
FIG. 16 is partial bottom plan view of still another embodiment of the removable cover.
Figure 17:
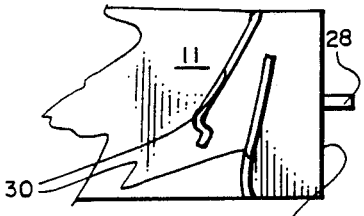
FIG. 17 is a partial bottom plan view of another embodiment of an end of the removable cover.

In the preferred embodiment for the removably cover 10 illustrated in FIGS. 15, 16 and 17, the opposed sheet ends 15—15 may, or may not, have the corners 20 formed with the seams 22. As was previously stated for the preferred embodiment of the removable cover 10 illustrated in FIGS. 5 and 9, this would depend on whether or not if the sheet 11 of the removable cover 10 is dimensioned to perfectly superimposedly cover or fit the rectangular surface of the bench or table top such that the seams 22 can essentially snugly engage the general vertical section of the corners of the rectangular surface. In the preferred embodiment for sheet 11 in FIGS. 15 and 16, a pair of loops 28—28 is secured to each of the opposed sheet ends 15—15 between the respective pair of seams 22—22, or between the corners of the opposed sheet ends 15—15 in the event that the opposed sheet ends 15—15 do not have the corners 20—20 formed respectively with the seams 22—22. With respect to the embodiment of the sheet 11 for the removable cover 10 in FIG. 15, the opposed sheet sides 13—13 include another pair of loops 28—28 opposedly secured perimetrically thereto in proximity to each of the opposed sheet ends 15—15. FIG. 14, sheet 11 has a structure defining a plurality of apertures 36 in close proximity to its respective sheet end 15. The pair of outer straps 30—30 secured to the pair of opposed sheet sides 13—13 in FIG. 14 slidably, removably pass under the rectangular surface and through the apertures 36 and bind together to releasably secure sheet 11 of the removable cover 10 to the top of the rectangular surface. In FIGS. 10 and 14, apertures 36 are generally away from the top of the rectangular surface and extend generally over the breadth edge thereof in order to be available to receive the respective pair of outer straps 30—30.

Figure 18:
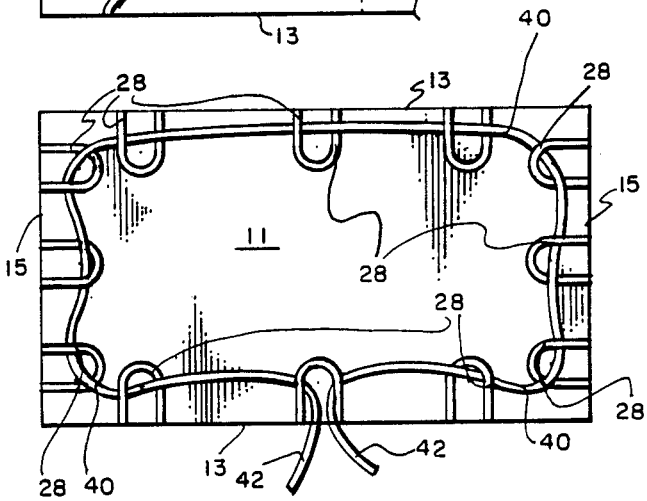
FIG. 18 is a bottom plan view of the removable cover having a plurality of loops perimetrically attached thereto with a strap slidably, removably passing through all of the loops.
Figure 19:
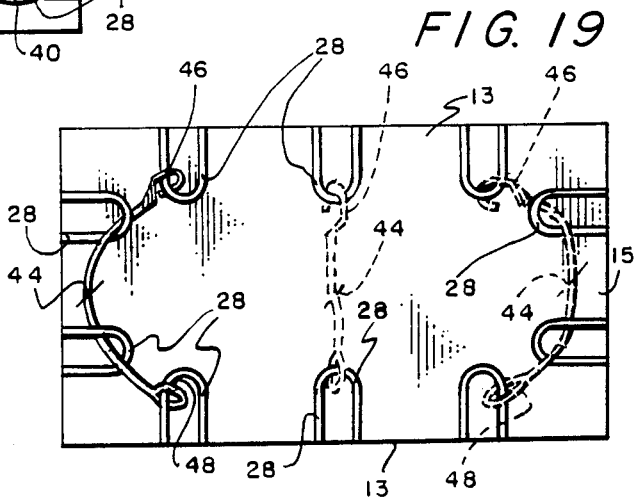
FIG. 19 is a bottom plan view of a removable cover with a plurality of loops perimetrically secured thereto, and a cord means with a hook releasably secured to and through some of the loops.
Figure 20:
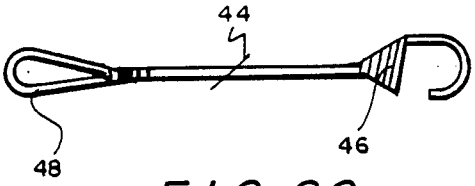
FIG. 20 is a top plan view of the cord means with the hook bound to an end thereof.

Continuing to refer in detail now to the drawings, particularly to FIGS. 18, 19 and 20 for two more embodiments of the removably cover 10, sheet 11 has a plurality of loops 28 secured perimetrically along its pair of opposed sheet sides 13—13 and its opposed sheet ends 15—15. The loops 28 would generally hang or extend over the breadth and longitudinal edges of the rectangular surface.

In the embodiment for FIG. 18, a strap 40 having strap ends 42—42 is provided. Strap 40 slidably, removably passes through all of the plurality of loops 28 as illustrated in FIG. 18 to releasably secure the sheet 11 over or onto the top of the rectangular surface. Strap ends 42—42 are available to be releasably bound together.

In FIG. 19, a shock or elastic cord means 44 (see FIG. 20) has an end with a ring means 48 and another end with a cone spring hook means 46. The ring 48 engages one of the loops 28 along a sheet side 13 that is closest to one of the sheet ends 15. The remaining structural portion of the cord 44 passes underneath the rectangular surface and inserts through the loops 28 that are secured to the sheet end 15 contiguous to the loop 28 that is secured by the ring 48. The hook 46 engages releasably the loop 28 on the opposed sheet side 13 which is directly opposed to the loop 28 on the other sheet side 13 that has been engaged by the ring 48. A second cord 44 is preferably similarly secured to and through the loops 28 on the sheet sides 13—13 and the opposed sheet end 15 of the other end of the sheet 11, as represented by dotted lines in FIG. 19. Preferably, a third cord 44, as also represented by dotted lines in FIG. 19, has its ring 48 bound to a sheet side loop 28 which is between two loops 28 on the sheet side 13 that have respectively engaged one end of the other two cords 44—44. The hook 46 for the third cord 44 passes underneath the rectangular surface and engages releasably a loop 28 on the opposed sheet side 13 directly opposed to the loop 28 on the other opposed sheet side 13 that has engaged the ring 48 of the third cord 44. The loop 28 on the sheet side 13 that is releasably engaged by the hook 46 of the third cord 44 is between two loops 28—28 on the same opposed sheet side 13 that have been engaged releasably by the hook 46—46 on the other two cords 44—44.

In a preferred embodiment of the invention, the removable cover 10 comes in a set of two covers 10—10 for a pair of benches and one cover 10 for the top of a table (see FIG. 1). The three covers 10—10—10 would be dimensioned in accordance with the particular benches and table to be covered. Obviously, the removable cover 10 that is to cover the table would be of larger dimensions that the two covers 10—10 that are to cover the pair of benches. To facilitate carrying the removable cover set, a bag 50 is provided. The removable cover set is cylindrically rolled and slidably placed into the bag 50.

The bag 50 is generally cylindrical with stitches 52 disposed longitudinally. The bag 50 includes a top defined by a bag circumferential loop 54 which is similar to, but larger than, the panel loops 32. A string means 56 is slidably disposed through the bag circumferential loop 54 in order to decrease the size of the opening through the top of the bag 50 by tightening the string 56 in order to crimp the circumferential loop 54. This enables the removable cover set to be retained within the bag 50. Whenever it is desired to remove the removable cover set, the string is loosened to uncrimp the circumferential loop 54 and increase the size of the opening through the top of the bag 50.

In a preferred embodiment of the invention, all straps 30 including strap 40 with strap ends 42—42 include a fastening means on the ends thereof, as opposed to merely tieing the ends together as illustrated in FIG. 2. Fastening means may be any suitable fastening means but is preferably the metallic snap means 58 (see FIG. 7), such as are used in clothing and the like, or the matching of a plurality of loops 60 with a plurality of hooks 62 (see FIG. 6), which matching has come to be known as "Velcro". The plurality of loops 60 and hooks 62 may each be a plurality of synthetic threads woven into the ends of the straps 30 and the strap end 42.

The plurality of interconnecting panels 12, the sheet 11, and the bag 50 may be manufactured of any suitable materials, such as pliable plastic (e.g. polyethylene, polypropylene, etc.) or any other pliable impermeable material. Preferably, panels 12, the sheet 11, and the bag 50 are manufactured of polyvinylchloride (PVC) on a 100% polyester non-woven backing. We have discovered that auto vinyl top material as being suitable for manufacturing the panels 12, the sheet 11, and the bag 50.

The straps 30, strap 40, and loops 28 may also be made of any suitable material, such as of the canvas family, the elastic family, or any other material that may accomplish the purposes for the strap 40, straps 30 and loops 28. More preferably, straps 30, strap 40, and loops 28 are made of a soft canvas material.

The removable cover 10 of this invention provides for comfort, cleanliness, protection of the skin and clothing, convenience, and beauty. The removable cover 10 when properly secured cannot blow-off, or otherwise be moved out of position, from the rectangular suface which it is covering. It may be cleaned easily, and certain embodiments of the removable cover 10, are adaptable to fit on any size of bench and/or table.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

We claim:

1. A removable cover for a rectangular surface having four corners comprising a plurality of interconnecting panels having a pair of opposed outermost panels and adapted to overlie the top of the rectangular surface;

each of said pair of outermost panels having a pair of opposed panel sides and a pair of corners including a seam at each corner such that when the cover removably lodges over the top of the rectangular surface, each of the seams essentially snugly engages the general vertical section of one of the corners of the rectangular surface and a breadth depending skirt is integrally formed having a width approximately equaling the length of the seams and extending over the breadth edge of the rectangular surface; each of the plurality of interconnecting panels has a pair of opposed panel sides, and when each of the seams essentially snugly engages the general vertical section of one of the corners of the rectangular surface a length depending skirt is integrally formed along the pair of opposed panel sides for all of said plurality of interconnecting panels, said length depending skirt having a width approximately equaling the length of the seams and extending over the longitudinal edge of the rectangular surface;

the distance between the pair of seams for any of the pair of outermost panels is less than the width of the respective outermost panel;

any two contiguous interconnecting panels comprises at their respective interconnecting points a pair of interconnected panel loops defined from looping two respective contiguous panel edges of the two contiguous panels and securing the looped panel edges to the structure of the respective contiguous panels and subsequently interconnecting the respective panel loops of the two contiguous panels;

a first pair of loops secured to each of the pair of outermost panels between the respective pair of seams;

a second pair of loops opposedly secured to the pair of opposed panel sides of each of the pair of outermost panels;

and a pair of outer straps opposedly secured to the pair of opposed panel sides of each of the pair of outermost panels and each respective pair of outer straps is adapted to slidably, removably pass through one of the first pair of loops and one of the second pair of loops and bind together to releasably secure the cover to the top of the rectangular surface.

2. The removable cover of claim 1 additionally comprising at least one pair of inner straps opposedly secured to the pair of opposed panel sides of a panel positioned between the pair of outermost panels.

3. The removable cover of claim 2 wherein said cover defines a bench cover, and said rectangular surface is the top of a bench.

4. The removable cover of claim 2 wherein said rectangular surface is the top of a table, and said cover defines a table cover.

5. The removable cover of claim 3 wherein said outer and inner straps include a means for fastening on their respective ends to secure their respective ends together.

6. The removable cover of claim 4 wherein said outer and inner straps include means for fastening on their respective ends to secure their respective ends together.

7. A removable cover for a rectangular surface having four corners comprising a sheet having a pair of opposed sheet sides and adapted to overlie the top of the rectangular surface;

said sheet including a pair of opposed sheet ends, aach sheet end having a pair of corners including a seam at each corner such that when the cover removably lodges over the top of the rectangular surface, each of the seams essentially snugly engages the general vertical section of one of the corners of the rectangular surface and a breadth depending skirt is integrally formed having a width approximately equalling the length of the seams and extending over the breadth edge of the rectangular surface;

each of the seams essentially, snugly engages the general vertical section of one of the corners of the rectangular surface, a length depending skirt is integrally formed along the pair of opposed sheet sides, said length depending skirt having a width approximately equalling the length of the seams and extending over the longitudinal edge of the rectangular surface;

the distance between the pair of seams is less than the width of the sheet;

at least one pair of inner straps opposedly secured to the pair of opposed sheet sides and positioned between the pair of sheet ends;

a first pair of loops secured to each of the pair of opposed ends between the pair of respective pair of seams;

a second pair of loops opposedly secured to the pair of opposed sheet sides in proximity to each of the pair of sheet ends;

and a pair of outer straps opposedly secured to the pair of opposed sheet sides in proximity to each of the pair of sheet ends and each respective pair of outer straps is adapted to slidably, removably pass through one of the first pair of loops and one of the second pair of loops and bind together to releasably secure the cover to the top of the rectangular surface.

8. The removable cover of claim 7 wherein said cover defines a bench cover, and said rectangular surface is the top of a bench.

9. The removable cover of claim 7 wherein said rectangular surface is the top of a table, and said cover defines a table cover.

10. The removable cover of claim 8 wherein said outer and inner straps include a means for fastening on their respective ends to secure their respective ends together.

11. The removable cover of claim 9 wherein said outer and inner straps include fastening means for fastening on their respective ends to secure their respective ends together.

12. A removable cover of a rectangular surface having four corners comprising a sheet having four sheet corners and a pair of opposed sheet sides and adapted to overlie the top of the rectangular surface, said sheet including a pair of opposed sheet ends;

a first pair of loops secured to each of the pair of opposed sheet ends;

a second pair of loops opposedly secured to the pair of opposed sheet sides in proximity to each of the pair of opposed sheet ends;

and a pair of outer straps opposedly secured to the pair of opposed sheet sides in proximity to each of the pair of sheet ends and each respective pair of outer straps is adapted to slidably, removably pass through one of the first pair of loops and one of the second pair of loops and bind together to releasably secure the cover to the top of the rectangular surface means; and at least one pair of inner straps opposedly secured to the pair of opposed sheet sides between the connecting points of the outer straps to the sheet.

13. The removable cover of claim 12 additionally comprising at least one pair of inner straps opposedly secured to the pair of opposed sheet sides between the connecting points of the outer straps to the sheet means.

14. The removable cover of claim 13 comprising a first pair of loop means secured to each of the pair of opposed sheet ends.

15. The removable cover of claim 14 additionally comprising a second pair of loop means opposedly secured to the pair of opposed sheet sides in proximity to each of the pair of opposed sheet ends.

16. The removable cover of claim 12 wherein said cover defines a bench cover, and said rectangular surface means is the top of a bench.

17. The removable cover of claim 12 wherein said rectangular surface means is the top of a table, and said cover defines a table cover.

18. The removable cover of claim 16 wherein said outer and inner straps include a means for fastening on their respective ends to secure their respective ends together.

19. The removable cover of claim 17 wherein said outer and inner straps include means for fastening on their respective ends to secure their respective ends together.

* * * * *